United States Patent [19]

Frohbach

[11] 4,418,631

[45] Dec. 6, 1983

[54] APPARATUS FOR CONTROLLING A WIND PROPELLED SAILING DEVICE

[76] Inventor: Louis A. Frohbach, 7333 Oaklawn Ave., Edina, Minn. 55435

[21] Appl. No.: 314,731

[22] Filed: Oct. 26, 1981

[51] Int. Cl.[3] ..... B63H 9/04

[52] U.S. Cl. ..... 114/39; 114/97

[58] Field of Search ..... 114/39, 97–99, 114/102, 91; 441/74

[56] References Cited

U.S. PATENT DOCUMENTS

| | | | |
|---|---|---|---|
| 2,577,917 | 12/1951 | Root | 9/21 |
| 3,205,849 | 9/1965 | Thorndike | 114/102 |
| 3,273,528 | 9/1966 | Kiefer | 114/61 |
| 3,455,261 | 7/1969 | Perrin | 114/39 |
| 3,487,800 | 1/1970 | Schweitzer et al. | 114/39 |
| 3,742,886 | 7/1973 | Dillon | 114/61 |
| 3,933,110 | 1/1976 | Jamieson | 114/39 |
| 3,985,090 | 10/1976 | Rineman | 114/39 |
| 4,037,553 | 7/1977 | Marker | 114/91 |
| 4,061,099 | 12/1977 | Cook | 114/39 |
| 4,112,865 | 9/1978 | Carn | 114/270 |
| 4,192,247 | 3/1980 | Riordan | 114/39 |
| 4,235,182 | 11/1980 | Burger | 440/34 |

FOREIGN PATENT DOCUMENTS

| | | | |
|---|---|---|---|
| 2802340 | 7/1979 | Fed. Rep. of Germany | 114/39 |
| 2950844 | 6/1981 | Fed. Rep. of Germany | 114/102 |

*Primary Examiner*—Sherman Basinger

*Attorney, Agent, or Firm*—Kinney, Lange, Braddock, Westman & Fairbairn

[57] ABSTRACT

A wind propelled sailing device, such as a wind surfer, having a hull and a mast pivotally attached thereto with a substantially lateral boom extending from the mast and a sail for receiving wind is controlled in an improved manner through an apparatus that aids a sailor in counterbalancing the force generated by the wind. The apparatus includes a substantially rigid control member preferably including a pair of spaced-apart rigid rods pivotally connected at one end to the boom in an angular direction and rigidly connected to each other at a second end with a handle member. A connecting mechanism connects the rigid rods to the boom in an angular direction while preventing movement of the control member along the boom's axis. The apparatus allows the sailor to increase his counterbalancing force by allowing the sailor to lean further into the wind while minimizing reduction in effective sail area.

8 Claims, 6 Drawing Figures

APPARATUS FOR CONTROLLING A WIND PROPELLED SAILING DEVICE

BACKGROUND OF THE INVENTION

1. Field of the Invention

The present invention relates to apparatus for controlling the movement and speed of wind propelled sailing devices. And in particular, it relates to an improvement in controlling wind propelled sailing devices having pivotally attached masts.

2. Description of the Prior Art

Boats propelled by sails have been known for thousands of years, and sailing as a recreation pasttime has become quite popular. In recent years, small sailboats have become increasingly popular. Several types of small sailboats are illustrated and described in the following patents:

Root, U.S. Pat. No. 2,577,917
Keifer, U.S. Pat. No. 3,273,528
Dillon, U.S. Pat. No. 3,742,886
Jamieson, U.S. Pat. No. 3,933,110
Cook, U.S. Pat. No. 4,061,099
Riordan, U.S. Pat. No. 4,192,247

One particular type of small sailboat has become extremely popular in the past ten to fifteen years. The sailboat, generally known by the brand name WINDSURFER, is characterized by a sleek hull made of a board having a mast pivotally attached to the board by a universal pivot connection. Generally referred to as a free sail surfboard, the apparatus is described in the Schweitzer et al U.S. Pat. No. 3,487,800. As of 1980, about 400,000 of the free sail surfboards have been sold since the filing of the Schweitzer et al Patent.

The free sail surfboard is operated standing on the hull and holding the sail upright by handling a substantially lateral boom which at one end is attached to the mast. Typically, the boom is a double boom of a generally wishbone-type configuration with the mast and the sail between the outwardly exending sides of the boom.

With the sailor holding the mast generally upright, the sail catches the wind which provides the motive force for the free sail surfboard. However, when the wind gets stronger, the sailor must lean into the wind to counterbalance off the increased force of the wind, or else the sail and mast will be blown into the water. As the force of the wind increases, the sailor must further lean into the wind until his arms are fully extended. If the wind continues to get stronger, the sailor leans the sail into the wind since he cannot make his arms any longer. This maneuver, which is helpful in keeping control of the sail, reduces the effective area of the sail. Reducing the effective area of the sail prevents the capture of an optimum amount of wind, thereby reducing the optimum amount of motive force for the free sail surfboard.

Several prior art patents illustrate aids in helping to control the sails on small sailboats. The Rineman U.S. Pat. No. 3,985,090 shows a small sailboat of the outrigger type. The sailboat includes a hand rudder and a sail control lever attached to the sail by flexible lines. The Perrin U.S. Pat. No. 3,455,261 illustrates a wind surfing device having a sail attached to the board by a rope which is attached at one end to the sail and attached at the other end to an eye hook in the board. Both the Rineman and Perrin Patents illustrate control devices for sails which would not be useful in controlling the sail in the free sail surfboard of the general type described in the Schweitzer et al patent.

The Carn U.S. Pat. No. 4,112,865 discloses a harness which includes a chest belt for placement around the sailor and a hook arrangement for hooking around the boom of the free sail surfboard. The harness, however, is primarily a safety device and an aid for resting the sailor's arms, and is of little help in controlling the free sail surfboard in high winds.

The Burger U.S. Pat. No. 4,235,182 illustrates a traction device for use with free sail surfboards. The traction device has partial glove-like portions which are used to grip the boom and are connected to the sailor by a pair of lines attached to a chest harness. The traction device of the Burger Patent, although helpful in gripping the boom, does not solve the problem of the reduced sail area which results from trying to avoid being overpowered by the wind.

SUMMARY OF THE INVENTION

The present invention includes an apparatus for improving control of a wind propelled sailing device, such as a free sail surfboard. The apparatus allows the sailor to lean more fully into the wind, increasing his effective force against the wind, while minimizing reduction of the effective sail area of the sail.

The free sail surfboard generally includes a water-engaging hull and a universally pivotal sail, pivotally attached to the top of the hull to receive wind for providing a motive force to the surfboard. A substantially lateral boom, preferably extending around the mast on both sides in a wishbone-type configuration, provides a grip to hold and operate the universally pivotal sail. The control apparatus of the present invention includes a substantially rigid control member pivotally connected in an angular direction to the boom at one end, and having a handle member at a second end. A connecting mechanism pivotally connects the control member in the angular direction and prevents movement of the control member along the boom's axis.

Preferably, the control member includes a pair of spaced-apart rigid rods pivotally connected to the boom at one end and rigidly connected to each other at the other end by a rigid handle member. The rods, handle member and boom are in sufficient rigid relationship to each other such that when the sailor moves the handle member, the boom moves in a similar fashion to control the sail. The control member, therefore, essentially acts as an extension of the boom. With the control member of the present invention effectively lengthening the sailor's arms, the sailor may lean back to increase his effective force against the wind while minimizing reduction of the effective sail area of the sail.

DETAILED DESCRIPTION OF THE PREFERRED EMBODIMENTS

Figure 1:
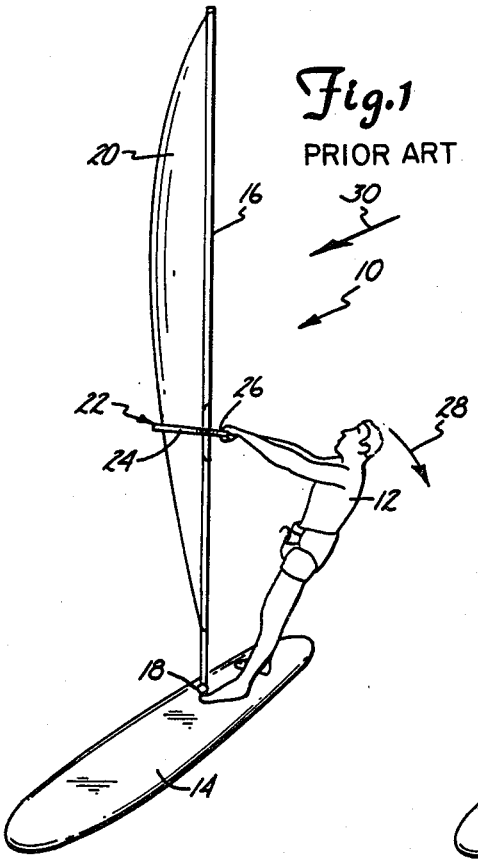
Fig.1 PRIOR ART
FIG. 1 is a perspective view of a prior art free sail surfboard with the mast and sail substantially upright, and the sailor leaning slightly into the wind with his arms fully extended.
Figure 2:
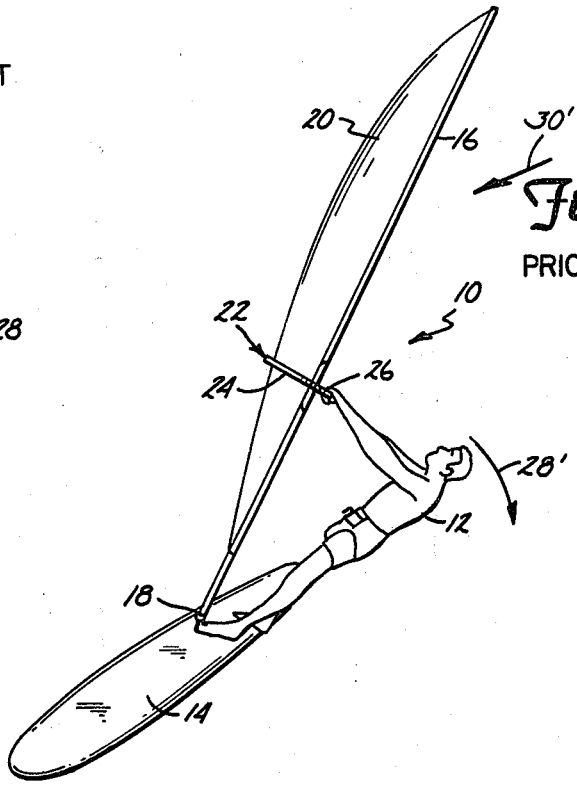
Fig.2 PRIOR ART
FIG. 2 is a perspective view of the prior art free sail surfboard being operated in a stronger wind with the sailor having his hands fully extended leaning into the wind and leaning the mast and sail into the wind, which reduces the effective sail area of the sail.

The free sail surfboard of the prior art is generally indicated at 10 in FIGS. 1 and 2 and is generally described in the Schweitzer et al U.S. Pat. No. 3,487,800, the description being hereby incorporated by reference. To operate and control the free sail surfboard, a sailor 12 stands on the top surface of a hull 14 (commonly referred to as the board) which floats on the surface of the water. A mast 16 is pivotally connected to the board 14. The pivotal connection is of a universal type, generally indicated at 18. A sail 20 is attached to the mast 16 for receiving the wind and for providing the motive force to the free sail surfboard 10. A substantially horizontal boom 22 is fixedly attached to the mast 16 at one end and extends outwardly on both sides of the mast 16 to the rear of mast 16 to form boom sections 24 and 26 in the general shape of a wishbone.

To operate the free sail surfboard of the prior art, the sailor holds the mast 16 and the sail 20 in a substantially upright position by holding the boom 22 in a generally horizontal position. In addition, the sailor 12 leans back in the direction of arrow 28 providing a greater torque in the free sail surfboard to counter the force of the wind, indicated by arrow 30. With the sailor 12 leaning back, as illustrated in FIG. 1, the sail may be held upright with relative ease and comfort against a slight wind.

However, as the wind increases, the sailor 12 will need to produce more torque to counter the increased force of the wind and prevent the sail from pulling the mast and the sailor overboard into the water. An increase in wind is generally met with enthusiasm by a free sail surfboard sailor, since the increase in wind increases the speed at which the surfboard may be operated, and increases the potential number of maneuvers which can be made with the surfboard. However, the sailor must counter the increase in wind with a greater torque to control the sail. One method that is widely used includes the sailor leaning further back with his arms fully extended and leaning the sail into the wind, as illustrated in FIG. 2, thereby effectively increasing the torque and countering the force of the wind. However, the above method by leaning the sail 20 into the wind decreases the effective sail area reducing the amount of potentially available motive force for the surfboard 10. Decreasing the potential amount of motive force decreases the number and types of maneuvers that may be performed with the surfboard 10. The speed and manueverability of the prior art surfboards have a practical limit, since the further the sailor leans, the less the effective sail area.

Figure 3:
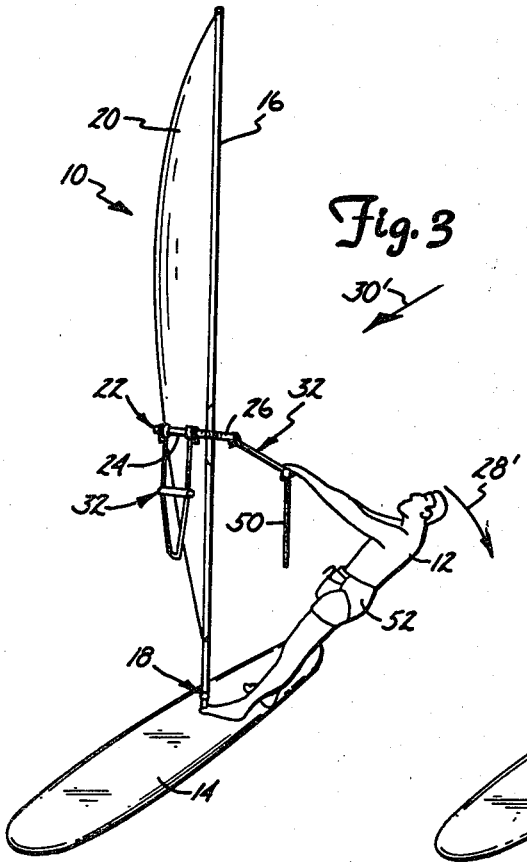
FIG. 3 is a perspective view of a free sail surfboard together with the control apparatus of the present invention allowing the sailor to lean further into the wind resulting in a greater force to counteract a higher wind force than the wind force in FIG. 1 while not reducing the effective area of the sail.

In FIGS. 3 through 6, similar reference numerals as used in FIGS. 1 and 2 are used to designate similar elements. The control apparatus of the present invention, generally indicated at 32 in FIGS. 3 and 4, allows the sailor 12 to create a greater torque by leaning in the direction as indicated by arrow 28' while the effective sail area stays the same for a given amount of wind force. For example, the force of the wind, as represented by arrow 30' in both FIGS. 2 and 3, is approximately the same. However, through the use of the control member 32 of the present invention, the sailor 12 can lean back the same distance, providing approximately the same torque to counter the wind and yet having a much greater effective sail area to receive the wind in FIG. 3 than in FIG. 2. The control member 32 in effect has lengthened the sailor's arms. The greater effective sail area provides a greater motive force to propel the free sail surfboard 10, providing more enjoyment and sport to the sailor 12.

For example, in FIG. 3, a 180 pound sailor using the control member 32 of the present invention produces a calculated 540 foot-pounds of torque to counter the wind. In contrast, in FIG. 1, using the same windsurfer without the control member 32 of the present invention with arms fully extended only 320 foot-pounds of torque are developed. In both cases the effective sail area is 100%.

Figure 4:
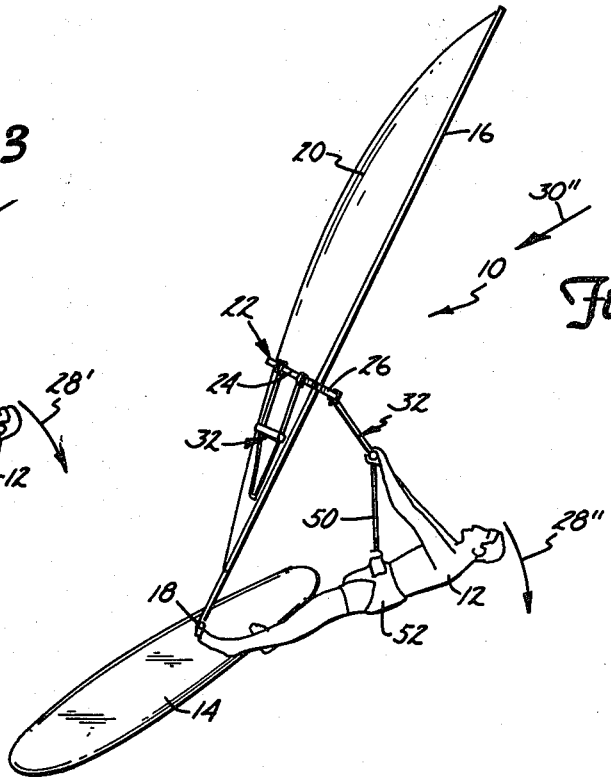
FIG. 4 is a perspective view of the present invention being used in a stronger wind than the one of FIG. 2, while essentially having the same effective sail area by allowing the sailor to counterbalance the wind force.

The control member 32 of the present invention also allows the free sail surfboard 10 to be used in much higher winds. As illustrated in FIG. 4, the control member 32 allows the use of the free sail surfboard 10 in much higher winds, as indicated by 30'', while using substantially the same effective sail area as compared to FIG. 2. The control member 32 allows the sailor 12 to lean further back as indicated by arrow 28'' thereby providing a further greater torque.

Figure 5:
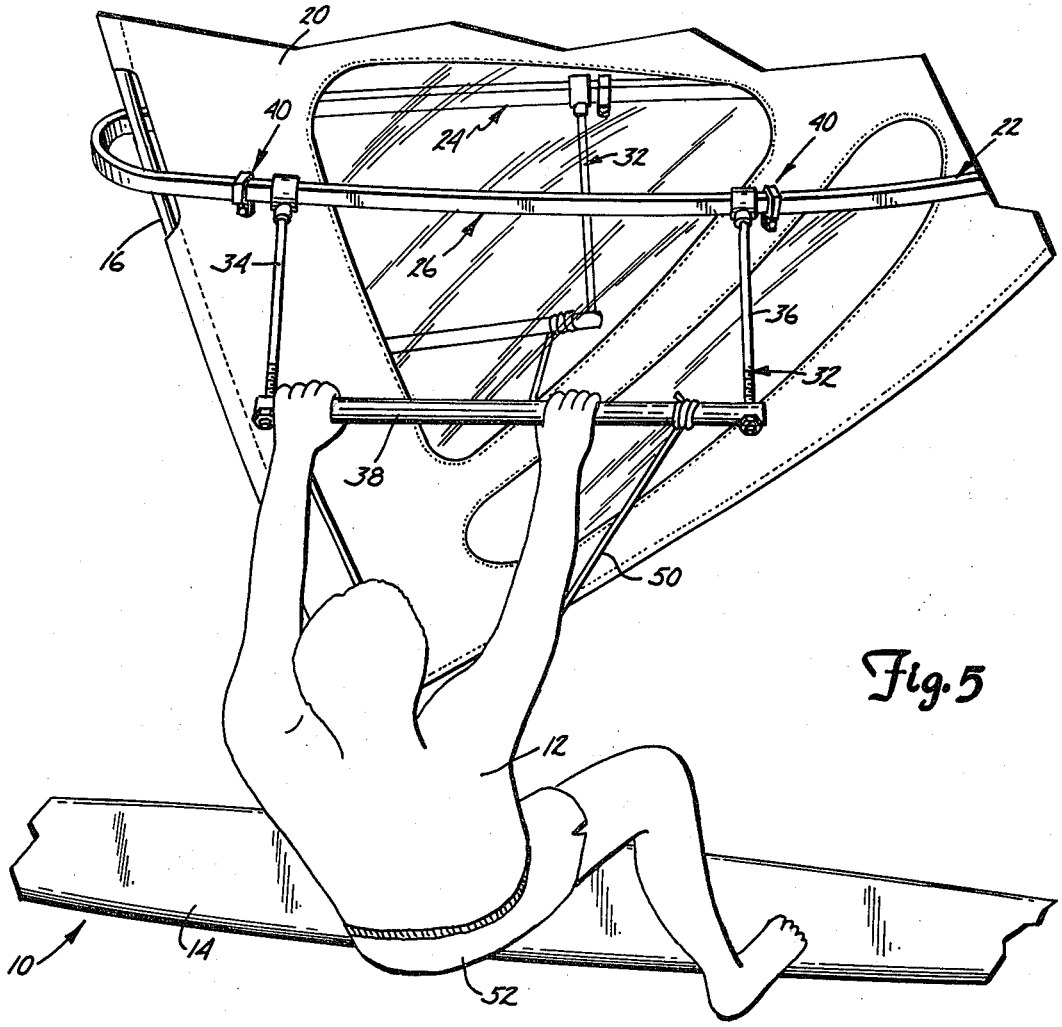
FIG. 5 is an enlarged perspective fragmentary side view showing the present invention in use.

The control member 32 is more fully illustrated in FIG. 5. The control member 32 includes a pair of spaced-apart substantially rigid rod members 34, 36. The rod members 34, 36 are rigidly connected to each other at a free end by handle member 38. At the other end, the rod members 34, 36 are pivotally connected to a boom section 24 or 26 of the boom 22. Preferably, the handle member 38 is substantially parallel to the boom 22. The rod members 34, 36 are pivotally connected in an angular direction while being held substantially stationary along the axis of the boom section 26.

Figure 6:
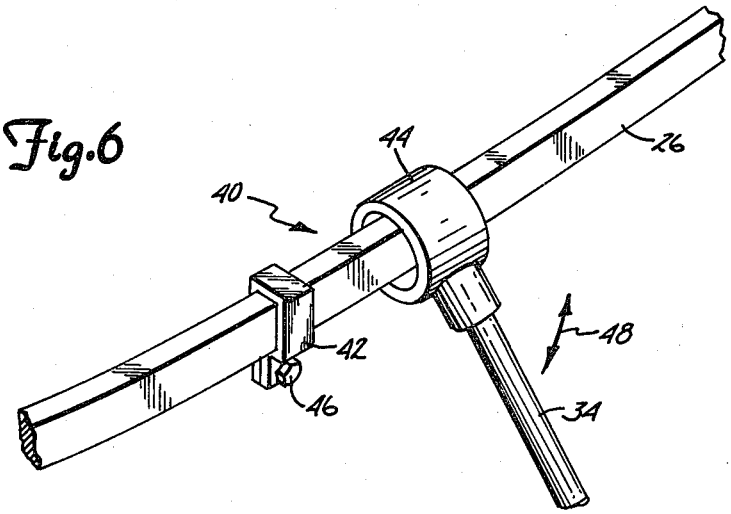
FIG. 6 is an enlarged perspective fragmentary view showing the pivotal connecting mechanism of the present invention.

In FIG. 6, a preferred embodiment of a pivotal connector 40 pivotally connects the rigid control member 32 in an angular direction but retains the control member 32 in a fixed position along the axis of the boom section 26. The pivotal connector 40 includes a stop member 42 and a sleeve member 44. The stop member 42 can be any suitable stop member that is fixedly attached to the boom section 26. As shown in FIG. 6, the stop member 42 is a bracket that tightly engages the boom section 26 when a bolt 46 is tightened bringing the ends of the bracket together. The sleeve member 44 is rigidly attached to the respective rod member 34 or 36 and encompasses the boom section 26 for pivoting in an angular direction as indicated by arrow 48. It will be understood by those skilled in the art that the pivotal connector may include the two separated members, as shown in FIG. 6, or the members may be rotatably connected to each in a suitable manner.

The rigid control member 32, in addition to allowing the sailor 12 to lean further back, also provides an extension of the boom 22. The handle member 38, the rod members 34, 36 and the boom section 26 forming a rigid member 32 allow the sailor to control the boom as if the sailor was holding directly onto the boom section 26. In effect, the control member lengthens the sailor's arms.

In one working embodiment, the sleeve member 44 was made of two-inch ID plastic tubing which was slipped over the wishbone boom 24, 26. The rod members 34, 36 were made of steel threaded rod approximately 18 inches long and rubber coated. The handle member was made of wood or aluminum, and was substantially parallel to the wishbone boom 24, 26. The handle was approximately 36 inches in length.

As shown in FIGS. 3 through 5, the rigid control member 32 is positioned on both boom sections 24 and 26. Positioning rigid control members 32 on both boom sections 24, 26 permits the sailor to sail the free sail surfboard 10 by standing on either side of the board 14. When not in use, the control member 32 pivots downwardly and out of the way.

In addition, a rope 50 and harness 52 connected to handle 38 are preferably used to aid the sailor when leaning out from the board 14 a greater distance, as shown in FIGS. 4 and 5. The rope 50 and harness 52 help to rest the sailor's arms and work as a safety device, keeping the sailor 12 attached to the free sail surfboard 10.

CONCLUSION

The rigid control member 32 of the present invention permits a sailor of a free sail surfboard to develop a greater torque to counterbalance the force of the wind and not reduce the effective sail area. In addition, no substantial loss of control is experienced when using the rigid control member of the present invention.

Although the present invention has been described with reference to preferred embodiments, workers skilled in the art will recognize that changes may be made in form and detail without departing from the spirit and scope of the invention.

What is claimed is:

1. An apparatus for aiding a sailer in controlling a wind propelled sailing device, the wind propelled sailing device including a water engaging hull means and a sail means having a sail for receiving wind for motive power pivotally attached to the hull means and universally pivotable with respect to the hull means and having a substantially lateral boom for controlling the sail means, the boom being positioned about a lower end of the sail and along both sides of the sail, the apparatus comprising:

a substantially rigid U-shaped control member for transmitting forces from the sailer to the boom to control the steering of the sailing device, the control member having a pair of spaced-apart legs with spaced-apart first ends and having a handle portion extending between second ends of the legs, the handle portion being of sufficient length to permit grasping thereof by a pair of hands of the sailer so that the sailer can apply forces to the control member; and connecting means for pivotally connecting the spaced-apart first ends of the spaced-apart legs to the boom to permit pivotal movement of the control member about an axis of the boom and to transmit forces perpendicularly to the axis from the handle portion through the spaced-apart legs to the boom.

2. The improvement of claim 1 wherein the boom extends outwardly from the mast on both sides of the sail in a general wishbone type configuration and wherein there is a rigid member attached to the boom on both sides of the sail.

3. The improvement of claim 1 and further including: means for limiting movement of the rigid control member along the axis of the boom.

4. The device of claim 1 wherein the handle portion is substantially parallel to the boom.

5. A wind propelled sailing device comprising:

a water engaging hull;

a mast pivotally attached to the hull and universally pivotable with respect to the hull;

a sail attached to the mast;

a substantially lateral boom extending from the mast for holding the mast and controlling the sail, the boom being positioned above a lower end of the sail and along both sides of the sail;

a substantially rigid U-shaped control member having a pair of spaced-apart legs with spaced-apart first ends and a rigid handle portion connecting the legs, the handle portion being of sufficient length to permit grasping thereof by a pair of hands of the sailor so that the sailor can apply forces to the control member; and pivotal connecting means for pivotally connecting the spaced-apart first ends of the rigid control member to the boom to permit pivotal movement of the control member about an axis of the boom and to transmit forces perpendicularly to the axis from the handle portion through the spaced-apart legs to the boom.

6. The improvement of claim 5 wherein the boom extends outwardly from the mast on both sides of the sail in a general wishbone type configuration and wherein there is a rigid member attached to the boom on both sides of the sail.

7. The improvement of claim 5 and further including: means for limiting movement of the rigid control member along the axis of the boom.

8. The device of claim 5 wherein the handle portion is substantially parallel to the boom.

* * * * *

UNITED STATES PATENT AND TRADEMARK OFFICE

CERTIFICATE OF CORRECTION

PATENT NO. : 4,418,631

DATED : December 6, 1983

INVENTOR(S) : Louis A. Frohbach

It is certified that error appears in the above-identified patent and that said Letters Patent is hereby corrected as shown below:

In claim 1, line 8, the word "about" should read --above--.

Signed and Sealed this

*Sixteenth* Day of *October 1984*

[SEAL]

*Attest:*

GERALD J. MOSSINGHOFF

*Attesting Officer*

*Commissioner of Patents and Trademarks*